US011731855B2

(12) United States Patent
Qian

(10) Patent No.: US 11,731,855 B2
(45) Date of Patent: Aug. 22, 2023

(54) WINDING CORE TUBE WITH UNIFORMLY ROUGH SURFACE

(71) Applicant: Suzhou Tianyu Plastic Co., Ltd., Jiangsu (CN)

(72) Inventor: Xiaoren Qian, Jiangsu (CN)

(73) Assignee: Suzhou Tianyu Plastic Co., Ltd., Jiangsu (CN)

( * ) Notice: Subject to any disclaimer, the term of this patent is extended or adjusted under 35 U.S.C. 154(b) by 558 days.

(21) Appl. No.: 16/956,557

(22) PCT Filed: Sep. 2, 2019

(86) PCT No.: PCT/CN2019/103948
§ 371 (c)(1),
(2) Date: Jun. 20, 2020

(87) PCT Pub. No.: WO2021/035764
PCT Pub. Date: Mar. 4, 2021

(65) Prior Publication Data

US 2022/0135365 A1 May 5, 2022

(30) Foreign Application Priority Data

Aug. 23, 2019 (CN) ..... 201910781511.4

(51) Int. Cl.

| | |
|---|---|
| ***B65H 75/26*** | (2006.01) |
| ***B21C 47/02*** | (2006.01) |
| ***B21C 47/28*** | (2006.01) |
| ***B65H 23/24*** | (2006.01) |

(Continued)

(52) U.S. Cl.
CPC ..... *B65H 75/26* (2013.01); *B21C 47/02* (2013.01); *B21C 47/28* (2013.01); *B65H 23/24* (2013.01); *B65H 27/00* (2013.01); *B65H 75/14* (2013.01); *B65H 2701/1732* (2013.01)

(58) Field of Classification Search
CPC ..... B65H 75/14; B65H 75/26; B65H 23/24; B65H 27/00; B65H 2701/1732; B21C 47/02; B21C 47/28; B05D 1/06
See application file for complete search history.

(56) References Cited

U.S. PATENT DOCUMENTS 3,716,202 A * 2/1973 Thomas ..... D05B 57/28 264/429

FOREIGN PATENT DOCUMENTS

| | | | |
|---|---|---|---|
| CN | 101254871 | 9/2008 | |
| CN | 102161452 | 8/2011 | |
| CN | 102862872 A * | 1/2013 | ..... B65H 75/14 |

(Continued)

OTHER PUBLICATIONS

"International Search Report (Form PCT/ISA/210) of PCT/CN2019/103948," dated May 11, 2020, pp. 1-5.

*Primary Examiner* — Christopher R Harmon
(74) *Attorney, Agent, or Firm* — JCIP Global Inc.

(57) ABSTRACT

A winding core tube with a uniformly rough surface including a rotary barrel is provided. A circular through hole is provided at the inner side of the rotary barrel, a rotating sleeve is fixedly connected at the circular through hole of the rotary barrel, a circular through hole is provided at the outer side of the rotating sleeve, a connecting shaft is fixedly connected at the circular through hole of the rotating sleeve, the length of the connecting shaft is larger than that of the rotary barrel, and sprayed particles are sprayed on the outer side of the rotary barrel.

4 Claims, 4 Drawing Sheets

(51) Int. Cl.
*B65H 27/00* (2006.01)
*B65H 75/14* (2006.01)

(56) References Cited

FOREIGN PATENT DOCUMENTS

| | | | | | |
|---|---|---|---|---|---|
| CN | 105347111 | A | * | 2/2016 | |
| CN | 207524750 | | | 6/2018 | |
| DE | 1710114 | | | 3/1971 | |
| DE | 19615853 | A1 | * | 10/1997 | ..... B65H 75/14 |
| JP | S5647968 | | | 4/1981 | |
| JP | 2009087469 | A | * | 4/2009 | ..... B65H 75/14 |

* cited by examiner

WINDING CORE TUBE WITH UNIFORMLY ROUGH SURFACE

CROSS-REFERENCE TO RELATED APPLICATION

This application is a 371 of international application of PCT application serial no. PCT/CN2019/103948, filed on Sep. 2, 2019, which claims the priority benefit of China application no. 201910781511.4, filed on Aug. 23, 2019. The entirety of each of the above mentioned patent applications is hereby incorporated by reference herein and made a part of this specification.

BACKGROUND

Technical Field

The present disclosure relates to the field of winding core tubes, and more particularly to a winding core tube with a uniformly rough surface.

Description of Related Art

Copper and aluminum foil is an indispensable material used in power batteries. Copper and aluminum foil is an active metal. In dry air, a dense oxide film is immediately formed on the surface of copper and aluminum, so that copper and aluminum will not be further oxidized and can withstand water. However, copper and aluminum powder mixed with air is very easy to burn; molten copper and aluminum can violently react with water; copper and aluminum are amphoteric, easily soluble in strong bases and soluble in dilute acids. Due to good ductility, copper and aluminum commodities are often made into rods, sheets, foils, powders, ribbons, and filaments in shape. The content of copper and aluminum elements in the earth's crust is second only to oxygen and silicon, ranking third, and copper and aluminum elements are the most abundant metal elements in the earth's crust. In the development of the three important industries of aviation, construction, and automobiles, the characteristics of the materials used are required to have the unique properties of copper, aluminum, and alloys thereof, which greatly benefits the production and application of metals of copper and aluminum. Copper and aluminum are more widely used in daily life as copper and aluminum foil, which is also called fake silver foil in that its effect of hot stamping is similar to that of pure silver foil. Due to the soft texture, good ductility, and silver-white luster of copper and aluminum, the calendered sheet, if mounted on offset paper with sodium silicate and the like to make foil sheets of copper and aluminum, can also be used in printing. During the production of copper and aluminum foil, a winding core tube is necessary to store the copper and aluminum foil into a roll, so as to facilitate the transportation and use of the copper and aluminum foil.

In the process of using the winding core tube, because of being relatively soft, copper and aluminum foil is prone to generate wrinkles and bubbles when being stored into a roll, and because of being relatively smooth, copper and aluminum foil is not easy to wind tightly when wound with the winding core tube, so that slippage may occur during transportation of the copper and aluminum foil, which causes the copper and aluminum foil to fall off the winding core tube, resulting in waste. For this reason, a winding core tube with a uniformly rough surface is presented.

SUMMARY

In view of the deficiencies of the prior art, the present disclosure provides a winding core tube with a uniformly rough surface, which has the advantages of avoiding wrinkles when the copper and aluminum foil is wound, and smoothing the uneven surface of the copper and aluminum foil, etc., and solves the problem that the copper and aluminum foil will wrinkle and it is not easy to start up when the existing apparatus performs copper and aluminum foil winding.

The winding core tube with a uniformly rough surface of the present disclosure, including a rotary barrel, wherein a circular through hole is provided at the inner side of the rotary barrel, a rotating sleeve is fixedly connected at the circular through hole of the rotary barrel, a circular through hole is provided at the outer side of the rotating sleeve, a connecting shaft is fixedly connected at the circular through hole of the rotating sleeve, the length of the connecting shaft is larger than that of the rotary barrel, sprayed particles are sprayed on the outer side of the rotary barrel, and copper and aluminum foil is sleeved on the outer side of the rotary barrel.

In the winding core tube with a uniformly rough surface of the present disclosure, wherein the sprayed particles have a diameter range of 2-15 ym, the surface of the rotary barrel is sprayed with a reinforcement agent, the sprayed particles and the reinforcement agent adhere to each other, and the sprayed particles are irregular in shape.

In the winding core tube with a uniformly rough surface of the present disclosure, wherein a left side baffle is provided at the left side of the rotary barrel, an annular groove is provided at the inner side of the left side baffle, and the rotary barrel is rotatably connected to the annular groove of the left side baffle.

In the winding core tube with a uniformly rough surface of the present disclosure, wherein a right side baffle is provided at the right side of the rotary barrel, an annular groove is provided at the inner side of the right side baffle, the right side of the rotary barrel is rotatably connected to the annular groove of the right side baffle, and the right side baffle has the same size and diameter as the left side baffle.

Compared with the prior art, the beneficial effects of the present disclosure are:

According to the present disclosure, the sprayed particles are provided to enable winding of copper and aluminum foil to start up well when the copper and aluminum foil is being wound, and the sprayed particles can smooth an uneven surface of the copper and aluminum foil when the rotary barrel are being turned to wind the copper and aluminum foil, avoiding the occurrence of wrinkles upon copper and aluminum foil winding. In addition, the sprayed particles can be selected in accordance with different thicknesses of copper and aluminum foil, so that the friction between the copper and aluminum foil and the rotary barrel can be increased when the copper and aluminum foil is being wound. Therefore, after being stored into a roll, the copper and aluminum foil will not slip during transportation, facilitating transportation stability. Also, the copper and aluminum foil is rolled in a relatively uniform thickness and more tightly, so that the speed of storing into a roll can be increased, while reducing the risk of play during transportation, thereby improving the quality of copper and aluminum foil winding, and reducing wastes. After the copper and aluminum foil is wound, the friction of the rough matte surface during transportation is larger, making the copper and aluminum foil not susceptible to roll, which has more advantages than smooth surfaces. Moreover, the copper and aluminum foil is now getting thinner and thinner, a lower tension is required when winding, so the rough surface solves the problem of low-tension winding without rolling. Therefore, the effect is better for 4 ym copper aluminum foil.

BRIEF DESCRIPTION OF THE DRAWINGS

The accompanying drawings are included to provide a further understanding of the present disclosure and constitute a part of this disclosure. The exemplary embodiments and description thereof of the present disclosure serve to explain the present disclosure and are not intended to limit the present disclosure in any way. In the drawings.

Figure 1:
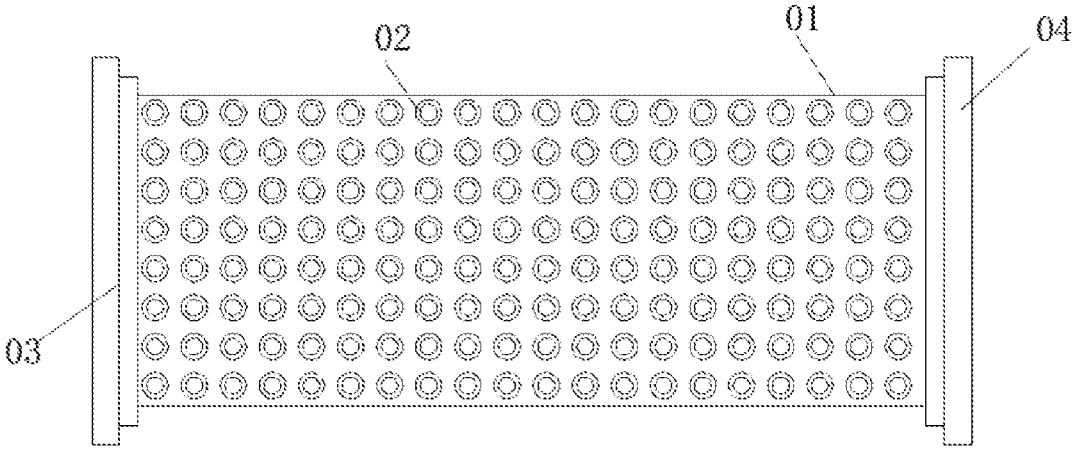
FIG. 1 is a sectional structural schematic view of the present disclosure.
Figure 2:
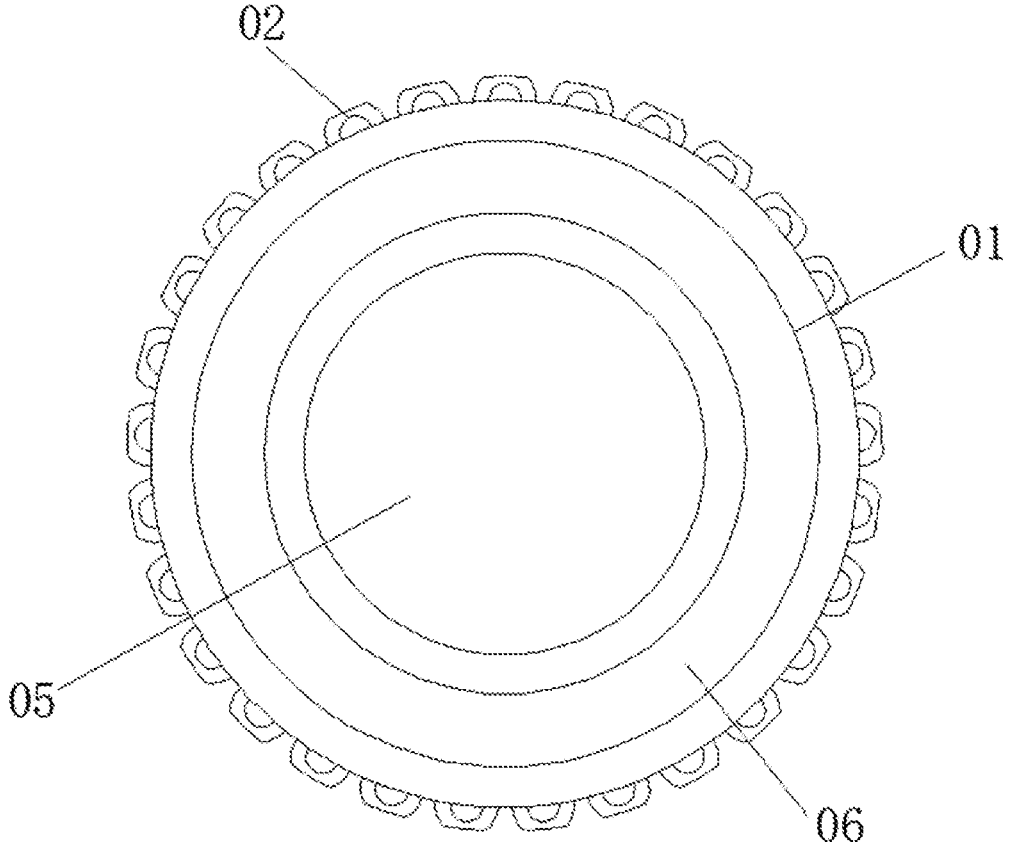
FIG. 2 is a side sectional structural schematic view of FIG. 1 of the present disclosure.
Figure 3:
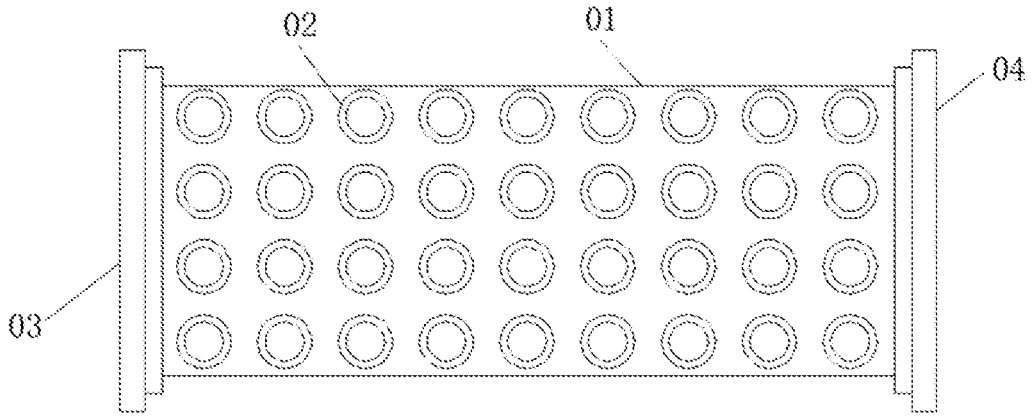
FIG. 3 is a sectional structural schematic view of the present disclosure.
Figure 4:
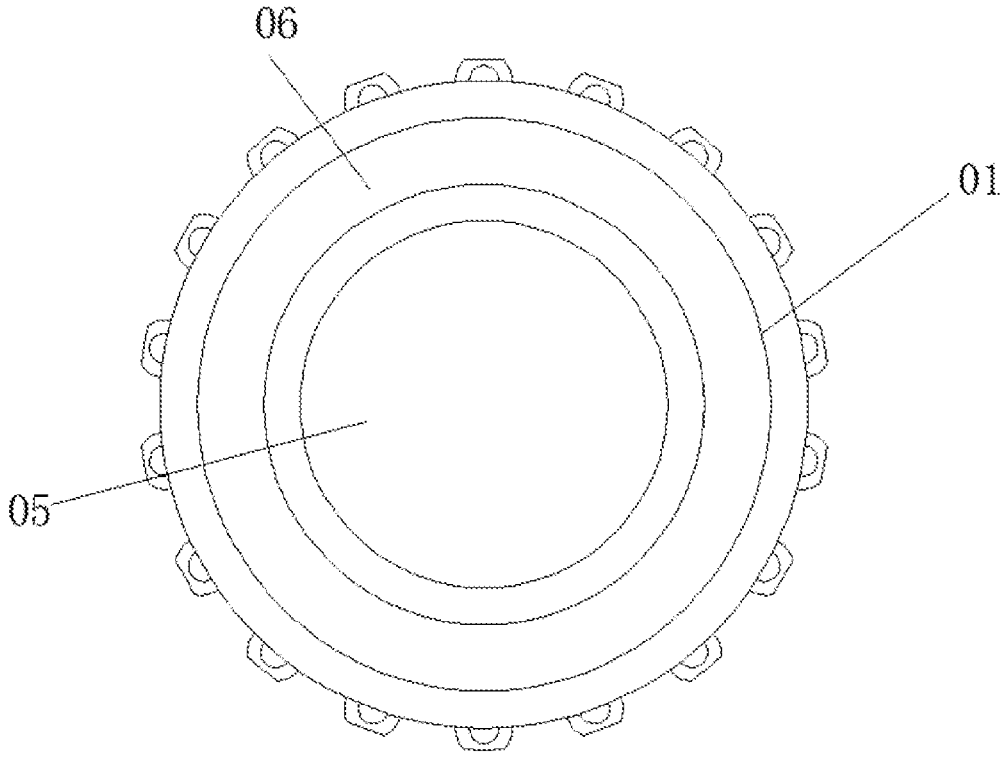
FIG. 4 is a side sectional structural schematic view of FIG. 2 of the present disclosure.

In the figures: 01, rotary barrel; 02, spraying particle; 03, left side baffle; 04, right side baffle; 05, connecting shaft; 06, rotating sleeve; 07, copper and aluminum foil.

DESCRIPTION OF THE EMBODIMENTS

Various embodiments of the present disclosure will be disclosed below by way of illustration, and for the sake of clarity, many practical details will be described in the following description. However, it should be understood that these practical details should not be used to limit the present disclosure. That is, in some embodiments of the present disclosure, these practical details are not necessary. Additionally, in order to simplify the drawings, some conventional structures and components will be illustrated in a simplified and schematic manner.

Additionally, the description of "first", "second" and the like in the present disclosure is merely for the purpose of description and are not intended to be indicate the order or the sequence, nor are they intended to limit the present disclosure. It is merely for distinguishing components or actions described in the same technical terms, and cannot be understood as indicating or implying its relative importance or implicitly indicating the number of technical features indicated. Thus, features defined with "first" and "second" may include at least one of said features, either explicitly or implicitly. In addition, the technical solutions between the various embodiments can be combined to each other, but this must be based on the ability of ordinary skilled in the art to achieve. When a combination of technical solutions conflicts or cannot be achieved, it should be considered that this combination of technical solutions does not exist, nor is it within the scope of protection claimed by the present disclosure.

Please refer to FIGS. 1-8. A winding core tube with a uniformly rough surface of the present disclosure includes a rotary barrel 01. A circular through hole is provided at the inner side of the rotary barrel 01, a rotating sleeve 06 is fixedly connected at the circular through hole of the rotary barrel 01, a circular through hole is provided at the outer side of the rotating sleeve 06, and a connecting shaft 05 is fixedly connected at the circular through hole of the rotating sleeve 06. The length of the connecting shaft 05 is greater than that of the rotary barrel 01, sprayed particles 02 are sprayed on the outer side of the rotary barrel 01, and copper and aluminum foil 07 is sleeved on the outer side of the rotary barrel 01. A left side baffle 03 is provided at the left side of the rotary barrel 01, an annular groove is provided at the inner side of the left side baffle 03, and the rotary barrel 01 is rotatably connected to the annular groove of the left side baffle 03. A right side baffle 04 is provided at the right side of the rotary barrel 01, an annular groove is provided at the inner side of the right side baffle 04, the right side of the rotary barrel 01 is rotatably connected to the annular groove of the right side baffle 04, and the right side baffle 04 has the same size and diameter as the left side baffle 03. The sprayed particles 02 are provided to enable the friction in copper and aluminum foil winding to increase when the copper and aluminum foil is wound by means of the rotary barrel 01, so that the copper and aluminum foil, when being wound into a roll, can better avoid the occurrence of wrinkles, while the copper and aluminum foil is prevented from slipping after its winding, resulting in more stability in copper and aluminum foil winding.

The diameter range of the sprayed particles 02 is 2-15 ym, the surface of the rotary barrel 01 is sprayed with a reinforcement agent, the sprayed particles 02 and the reinforcement agent adhere to each other, and the sprayed particles 02 are irregular in shape. The cooperation between the reinforcement agent and the sprayed particles 02 enables the sprayed particles 02 to attach to the rotary barrel 01 more stably, so that the sprayed particles 02 can function successfully.

Embodiment 1

Figure 5:
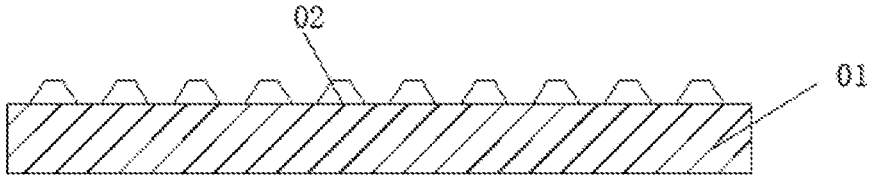
FIG. 5 is a sectional structural schematic view of sprayed particles of the present disclosure in a dense state.

Referring to FIG. 5, the diameter range of the sprayed particles 02 is set to 2-8 ym. Where copper and aluminum foil with a thickness of less than 6 ym is wound, the friction coefficient when the copper and aluminum foil just contacting the sprayed particles 02 is a low coefficient of friction compared to the case without providing sprayed particles 02, which facilitates smoothing and flattening of the copper and aluminum foil, and helps to start up the copper and aluminum foil winding.

Embodiment 2

Figure 6:
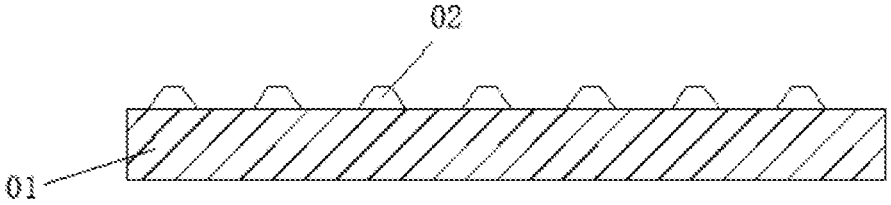
FIG. 6 is a sectional structural schematic view of sprayed particles of the present disclosure in a sparse state.
Figure 7:
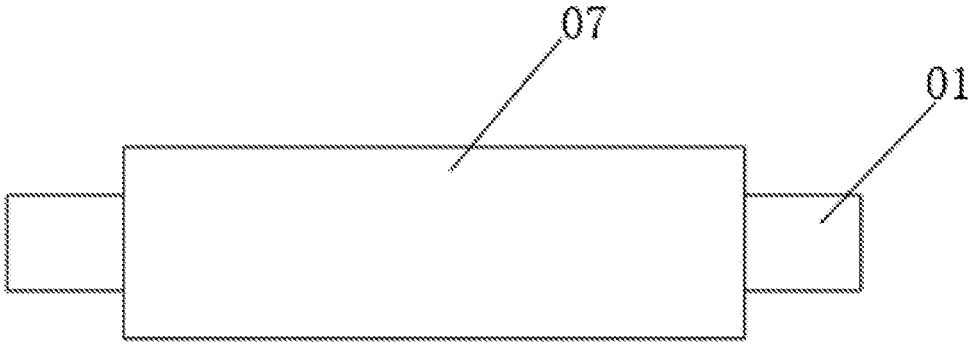
FIG. 7 is a schematic structural diagram of a rotary barrel wrapped with copper and aluminum foil of the present disclosure.
Figure 8:
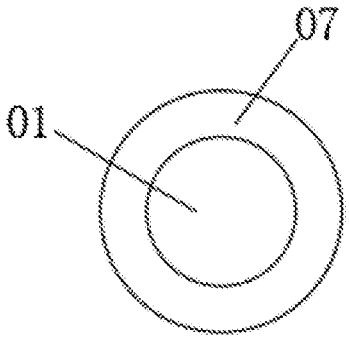
FIG. 8 is a side sectional structural schematic view of the rotary barrel of the present disclosure.

Referring to FIG. 6, the diameter range of the sprayed particles 02 is set to 9-15 ym. Where copper and aluminum foil with a thickness of more than 6 ym is wound, because of a large spacing between the sprayed particles 02, a gap is formed. That is to say, there is an exhaust path, so that when the copper and aluminum foil is being wound, gas can be discharged as quickly as possible, greatly reducing the phenomenon of wrinkling and bubbling in copper and aluminum winding. Compared to the case without providing sprayed particles 02, the copper and aluminum foil does not closely adhere the rotary barrel 01, such that the friction between the copper and aluminum foil and the flat rough surface formed by sprayed particles 02 on the surface of the rotary barrel 01 is increased, which can prevent the copper and aluminum foil from sliding on the rotary barrel 01 after being formed into a roll.

In using the present disclosure:

In use, a suitable diameter of sprayed particles 02 is first selected in accordance with the thickness of copper and aluminum foil to be wound; and a reinforcement agent and sprayed particles 02 are then together applied to the rotary barrel 01.

If the thickness of the copper and aluminum foil to be wound is below 6 ym, the diameter range of sprayed particles 02 is chosen to be 2-8 ym. In this case, copper and aluminum foil can be well attached on the rotary barrel 01, and when copper and aluminum foil is stored in a roll, this enables facilitating copper and aluminum foil smoothing and flattening, and helps to start up the copper and aluminum foil winding.

If the thickness of the copper and aluminum foil to be wound is above 6 ym, the diameter range of sprayed particles 02 is chosen to be 9-15 ym. In this case, copper and aluminum foil is attached on the rotary barrel 01, and also, an exhaust path is formed as a result of the gap between the sprayed particles 02, so that when copper and aluminum foil is being wound, gas can be discharged as quickly as possible, greatly reducing the phenomenon of wrinkling and bubbling in copper and aluminum foil winding.

The above are only the embodiments of the present disclosure and are not intended to limit the present disclosure. For those skilled in the art, the present disclosure may have various alterations and variations. Any modifications, equivalent substitutions, and improvements etc. made within the spirit and principle of the present disclosure shall fall within the scope of claims of the present disclosure.

What is claimed is:

1. A winding core tube with a uniformly rough surface, comprising a rotary barrel (01), wherein a first circular through hole is provided at an inner side of the rotary barrel (01), a rotating sleeve (06) is fixedly connected at the first circular through hole of the rotary barrel (01), a second circular through hole is provided at an outer side of the rotating sleeve (06), a connecting shaft (05) is fixedly connected at the second circular through hole of the rotating sleeve (06), a length of the connecting shaft (05) is larger than a length of the rotary barrel (01), sprayed particles (02) are disposed on an outer surface of the rotary barrel (01), wherein the sprayed particles (02) have a diameter range of 2-15 ym.

2. The winding core tube with the uniformly rough surface according to claim 1, wherein a reinforcement agent is disposed on the outer surface of the rotary barrel (01), the sprayed particles (02) and the reinforcement agent adhere to each other, and the sprayed particles (02) are irregular in shape.

3. The winding core tube with the uniformly rough surface according to claim 1, wherein a left side baffle (03) is provided at a left side of the rotary barrel (01), a first annular groove is provided at an inner side of the left side baffle (03), a left edge of the rotary barrel (01) is located in the first annular groove of the left side baffle (03), and the rotary barrel (01) is rotatably connected to the left side baffle (03).

4. The winding core tube with the uniformly rough surface according to claim 3, wherein a right side baffle (04) is provided at a right side of the rotary barrel (01), a second annular groove is provided at an inner side of the right side baffle (04), a right edge of the rotary barrel (01) is located in the second annular groove of the right side baffle (04), the rotary barrel (01) is rotatably connected to the right side baffle (04), and the right side baffle (04) has the same size and diameter as the left side baffle (03).

* * * * *